US006371594B1

(12) United States Patent
Takahashi et al.

(10) Patent No.: US 6,371,594 B1
(45) **Date of Patent: *Apr. 16, 2002**

(54) INK JET RECORDING HEAD, AN INK JET CARTRIDGE, AND AN INK JET RECORDING APPARATUS

(75) Inventors: Wataru Takahashi, Yokohama; Kazuaki Masuda, Kawasaki; Hajime Yamamoto, Yokohama; Eiichiro Shimizu, Urawa; Yasuo Kotaki, Yokohama; Teruo Arashima; Jun Hinami, both of Kawasaki, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/917,035

(22) Filed: Aug. 26, 1997

(30) Foreign Application Priority Data

Aug. 30, 1996 (JP) ..... 8-230446

(51) Int. Cl.[7] ..... B41J 2/015
(52) U.S. Cl. ..... 347/20
(58) Field of Search ..... 347/20, 63, 17

(56) References Cited

U.S. PATENT DOCUMENTS

| | | | |
|---|---|---|---|
| 4,994,825 | A | 2/1991 | Saito et al. |
| 5,095,321 | A | 3/1992 | Saito et al. |
| 5,208,604 | A | 5/1993 | Watanabe et al. |
| 5,257,043 | A | 10/1993 | Kneezel |
| 5,262,802 | A | 11/1993 | Karita et al. |
| 5,389,957 | A | 2/1995 | Kimura et al. |
| 5,485,184 | A | 1/1996 | Nakagomi et al. |

FOREIGN PATENT DOCUMENTS

| | | |
|---|---|---|
| EP | 0 602 021 | 6/1994 |
| JP | 7-052386 | 2/1995 |

*Primary Examiner*—John Barlow
*Assistant Examiner*—Michael S. Brooke
(74) *Attorney, Agent, or Firm*—Fitzpatrick, Cella, Harper & Scinto

(57) ABSTRACT

An ink jet recording head comprises a grooved ceiling plate provided with a plurality of discharge openings for discharging ink, and a plurality of ink flow path grooves to form ink flow paths conductively connected with the discharge openings, a plurality of elemental substrates provided with a plurality of electrothermal transducing devices to generate thermal energy used for discharging ink, and a metallic pressure member for pressing the plurality of elemental substrates to be in contact with the grooved ceiling plate. The grooved ceiling plate and the elemental substrates are coupled to enable the ink flow path grooves and the electrothermal transducing devices to correspond to each other for the formation of ink flow paths. Here, the pressure member presses the reverse side of the surface of the elemental substrates having the electrothermal transducing devices provided therefor in order to couple the elemental substrates with the grooved ceiling plate. With the structure thus arranged, heat generated by the elemental substrates is efficiently transferred to the pressure member for radiation even for an ink jet recording head having no base plate or having a smaller base plate than the conventional one, while coupling the substrates and ceiling plate closely and reliably for the attainment of high quality recording.

21 Claims, 11 Drawing Sheets

INK JET RECORDING HEAD, AN INK JET CARTRIDGE, AND AN INK JET RECORDING APPARATUS

BACKGROUND OF THE INVENTION

1. Field of the Invention

The present invention relates to an ink jet recording head to be formed by pressing a member that constitutes ink flow paths to be in contact with the head. The invention also relates to an ink jet cartridge and an ink jet recording apparatus provided with an ink jet recording head of the kind.

2. Related Background Art

Of the currently known various recording methods, an ink jet recording method is recognized as an extremely effective one, because this method is of a non-impact type that makes substantially no noises at the time of recording, while this method makes high-speed recording possible by use of an ordinary recording sheet without any particular fixing treatment given to the sheet.

FIG. 16 is a perspective view which schematically shows the general structure of the principal part of an ink jet recording head adoptable for the ink jet recording method described above. Also, FIG. 17 is a schematic view which shows the section taken along line 17—17 in FIG. 16.

In FIG. 16 and FIG. 17, a reference numeral 112 designates the elemental substrate (heater board) which is provided with a plurality of ink discharge pressure generating devices; 113, a grooved ceiling plate integrally formed with the grooves that become a plurality of ink discharge openings 101 and ink flow paths 105 conductively connected with the ink discharge openings 101, and also, with the recessed portions that become the wall portions 106 forming those of the ink flow paths, and a common liquid chamber 107 to supply ink to each of the ink flow paths 105; 111, a base plate (substrate) that forms each of the components thereon; 114, a spring member serving as means for mechanically pressing the ceiling plate 113 and the heater board 112 to be in contact with each other to constitute the ink flow paths 105 as described above.

The spring member 114 generates linear pressure by means of the folded end 114A, and presses the flat pressure portion 113B of the ceiling plate 113 arranged for the spring member so that the ceiling plate 113 and the heater board 112 are caused to be in contact. In this way, the spring member 114 is provided with the highly rigid folded end 114A whereby to press the flat upper surface 113B of the ceiling plate 113 in order to couple the two members, ceiling plate and substrate, by the application of pressure. This method has been in use conventionally.

However, an ink jet recording apparatus has been made increasingly smaller at lower costs in recent years. Along with such development, there is a need for making the structure of an ink jet recording head simpler. The structure, which is arranged to couple a ceiling plate with a substrate fixed to a base plate should be made simpler or smaller accordingly. Here, since the size of a head is determined by the size of the base plate, a structure may be arranged using a smaller-sized base plate or without using any base plate at all. Then, however, a problem arises that heat radiation, which is one of the functions to be provided by the base plate, becomes insufficient, and the temperature of the recording head having this structured is raised beyond a given temperature, hence causing the head to be damaged functionally, if ink in the ink flow paths should become short for some reasons.

Therefore, it is required to devise some means for controlling the temperature of the ink jet recording head structured as described above so as not to allow the temperature to rise more than a predetermined temperature.

SUMMARY OF THE INVENTION

The present invention is designed with a view to solving such problems. It is an object of the invention to provide an ink jet recording head capable of attaining high quality recording, while being structured without using any base plate or being structured to be smaller, but the temperature of such ink jet recording head is not caused to rise more than a predetermined temperature, while the substrate and ceiling plate thereof are in close contact. Further, it is an object of the invention to provide an ink jet recording apparatus having such ink jet recording head mounted on it for recording.

Here, it is required for a pressure member to obtain a high contactness between the ink flow path grooves of a ceiling plate and a substrate as its fundamental function. Therefore, it is another object of the invention to provide an ink jet recording head whose temperature is not caused to rise more than a predetermined temperature, while the substrate and ceiling plate are reliably in contact for the formation of such ink jet recording head.

In order to achieve each of the objectives described above, an ink jet recording head of the present invention comprises a grooved ceiling plate provided with a plurality of discharge openings for discharging ink, and a plurality of ink flow path grooves to form ink flow paths conductively connected with the discharge openings; a plurality of elemental substrates provided with a plurality of electrothermal transducing devices to generate thermal energy used for discharging the ink; and a metallic pressure member for pressing the plurality of elemental substrates to be in contact with the grooved ceiling plate, and the grooved ceiling plate and the elemental substrates being coupled to enable the ink flow path grooves and the electrothermal transducing devices to correspond to each other for the formation of ink flow paths, wherein the pressure member presses the reverse side of the surface of the elemental substrates having the electrothermal transducing devices provided therefor in order to couple the elemental substrates with the grooved ceiling plate.

Also, an ink jet recording head of the present invention comprises a grooved ceiling plate provided with a plurality of discharge openings for discharging ink, and a plurality of ink flow path grooves to form ink flow paths conductively connected with the discharge openings; a plurality of elemental substrates provided with a plurality of electrothermal transducing devices to generate thermal energy used for discharging the ink; and a metallic pressure member for pressing the plurality of elemental substrates to be in contact with the grooved ceiling plate, and the grooved ceiling plate and the elemental substrates being coupled to enable the ink flow path grooves and the electrothermal transducing devices to correspond to each other for the formation of ink flow paths, wherein on the reverse side of the elemental substrates having the electrothermal transducing devices provided therefor, a member having high thermal conductivity is arranged, and the pressure member presses the member having high thermal conductivity to couple the elemental substrates with the grooved ceiling plate.

In accordance with the present invention, heat generated by the elemental substrates is efficiently transferred to the pressure member for radiation even for an ink jet recording head having no base plate or having a smaller base plate than the conventional one, thus making it possible to prevent the temperature of the ink jet recording head from rising more than a predetermined temperature, while closely coupling the substrates and the ceiling plate reliable for the achievement of high quality recording.

Also, in accordance with the present invention, it is possible to perform ink discharges stable by closely coupling the substrates and the ceiling plate reliably.

Other objectives and advantages besides those discussed above will be apparent to those skilled in the art from the description of a preferred embodiment of the invention which follows. In the description, reference is made to accompanying drawings, which form a part hereof, and which illustrate an example of the invention. Such example, however, is not exhaustive of the various embodiments of the invention, and therefore reference is made to the claims which follow the description for determining the scope of the invention.

DETAILED DESCRIPTION OF THE PREFERRED EMBODIMENTS

Hereinafter, with reference to the accompanying drawings, the detailed description will be made of the embodiments in accordance with the present invention.

(Embodiment 1)

Figure 1:
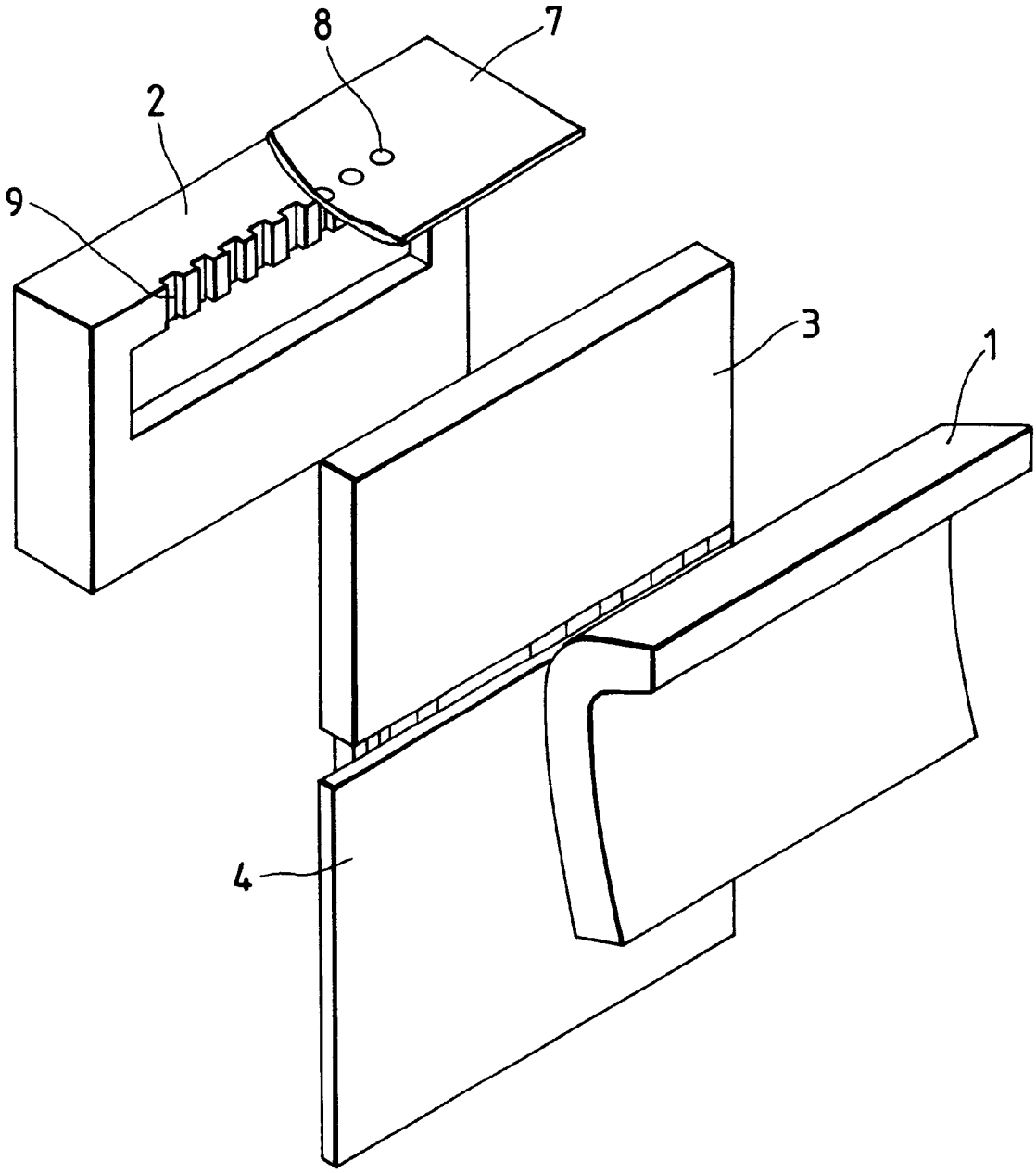
FIG. 1 is an exploded perspective view which shows an ink jet recording head in accordance with a first embodiment of the present invention.

FIG. 1 is an exploded perspective view which shows an ink jet recording head in accordance with a first embodiment of the present invention. The recording head is structured in such a manner that by use of a pressure member 1, a substrate 3, which is provided with electrothermal transducing devices to generate thermal energy utilized for discharging ink, is coupled with a grooved ceiling plate 2 provided with an ink tank unit (not shown), as well as with ink flow path grooves and discharge opening for discharging ink.

Also, one end of the substrate 3 is connected electrically with a wiring substrate 4 to transfer electric signals and the like, and the other end thereof is coupled with the ceiling plate 2. This coupling is made in such a way that the ink flow paths (grooves) 9 conductively connected with the discharge openings 8 formed on the orifice plate 7 of the ceiling plate 2 is arranged corresponding to the position of each of the electrothermal transducing devices described above. By means of such coupling, the ink flow paths and liquid chamber are formed. Therefore, in order to obtain stable ink discharges, the substrate 3 and the ceiling plate 2 should be in close contact so that each of the ink flow paths thus formed by this coupling should not be affected by pressure of ink discharges to be made in the respective ink flow paths. In order to make the coupling reliably, the pressure member 1 is adopted to press the ceiling plate 2 and the substrate 3 to be closely in contact.

Figure 2:
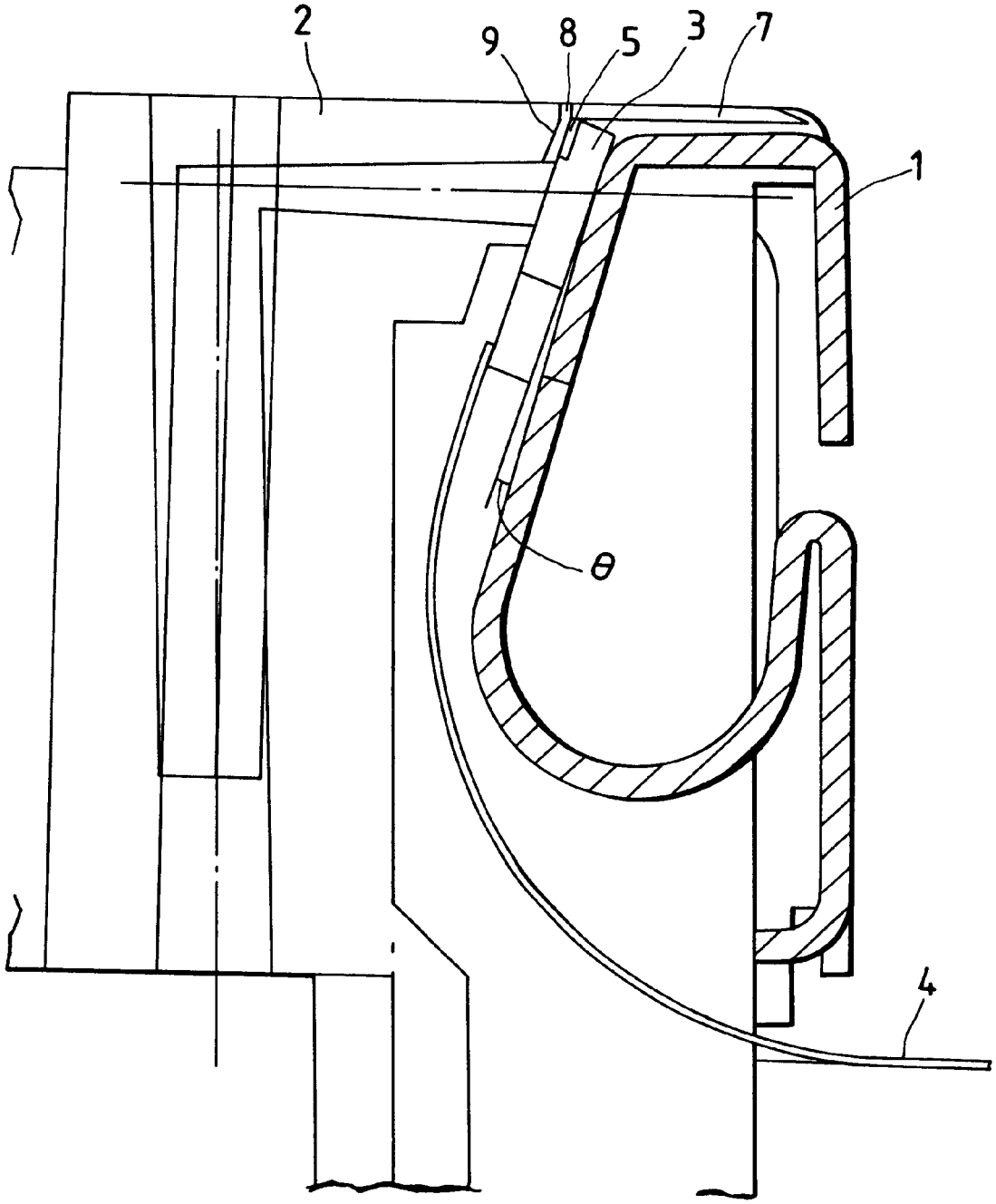
FIG. 2 is a cross-sectional view which shows the principal part of the ink jet recording head represented in FIG. 1.

With reference to FIG. 2, the state of such coupling will be described. FIG. 2 is a cross-sectional view which shows the principal part of the recording head represented in FIG. 1. The pressure member 1 presses the reverse side of the substrate 3 in the vicinity of the heat generating source 5 by the application of linear pressure at a contact angle of $\theta$. Here, in consideration of the close contact between the ceiling plate 3 and the substrate 3, the ink flow paths should be securely pressed by the application of linear pressure as a preferable state of pressure being exerted on them, while in consideration of the radiation of heat generated by the substrate 3, the larger the contact area, the higher is the coefficient of thermal conductivity, hence leading to a good heat radiation.

In this respect, therefore, although it is preferable to set the contact angle $\theta$ at zero degree between the pressure member 1 and the substrate 3 from the viewpoint of thermal conductivity, the angle should be $\theta>0°$ from the viewpoint of close contactness between them. Further, in accordance with the present embodiment, it is arranged to incline the ink flow path grooves of the ceiling plate 2 with respect to the orifice plate. Thus, the pressure member 1 presses the substrate 3 in the directions of the ink flow path grooves and orifice plate as well. In this manner, the discharge opening side of the ink flow path grooves, in which gaps tend to occur in accordance with the conventional art, can be securely put in close contact when the substrate is pressed down to the orifice plate in accordance with the present embodiment.

Also, in order to make the heat radiation higher, it is preferable to apply a metallic paste or some other material of a high thermal conductivity to the gap between the substrate and the pressure member.

Figure 3:
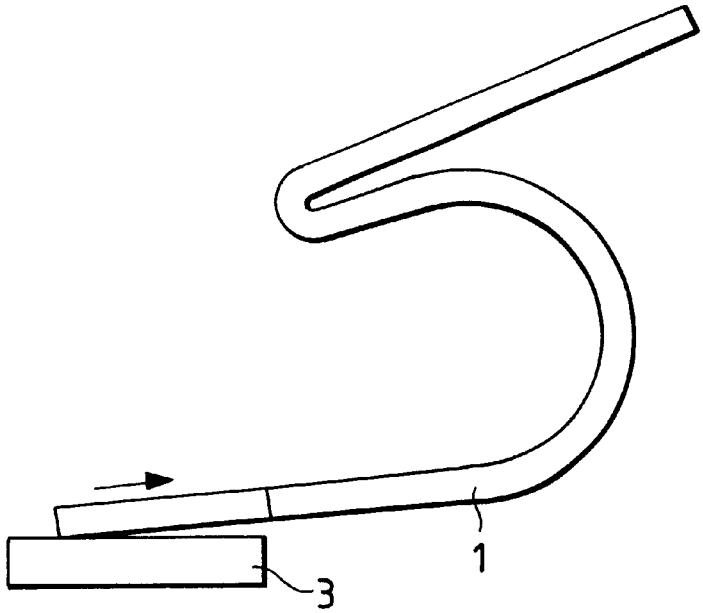
FIG. 3 is an enlarged sectional view which shows the state of the pressure member being in contact.

Also, in consideration of the fact that the pressure member 1 is a plate formed by metal or the like, the configuration of the pressing portion of the pressure member 1, which is in contact with the substrate 3, allows heat to be transferred in the direction indicated by an arrow when the substrate 3 is pressed down by the end face of the plate member as shown in FIG. 3 which illustrates sectionally the contact state of the pressure member.

Figure 4:
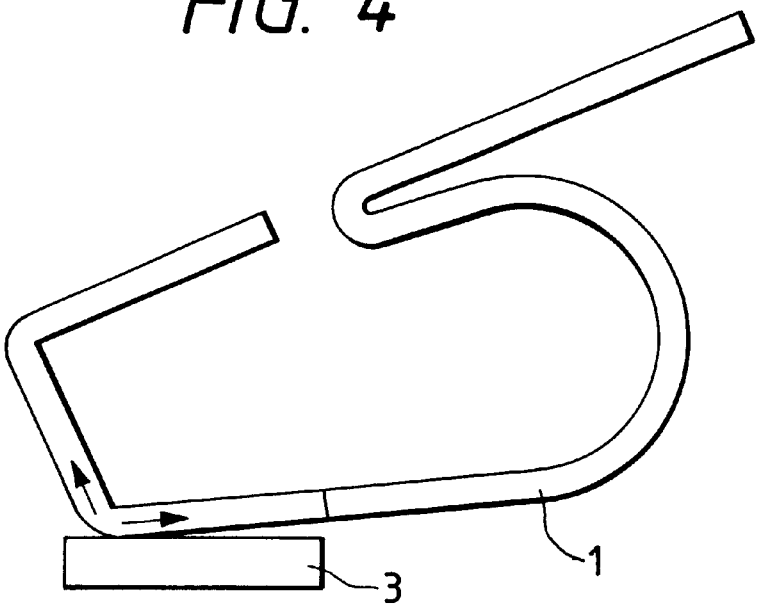
FIG. 4 is an enlarged sectional view which shows the state of the pressing portion of the pressure member being folded.

Here, in contrast to this structure, the pressing portion is folded as shown in FIG. 4 which illustrates sectionally the contact state of the pressure member. In this case, the thermal conductivity becomes bidirectional indicated by arrows in FIG. 4 instead of the one direction shown in FIG. 3. Therefore, the sectional area that acts upon the thermal conductivity becomes approximately double to make the efficiency of heat radiation better.

Figure 5A:
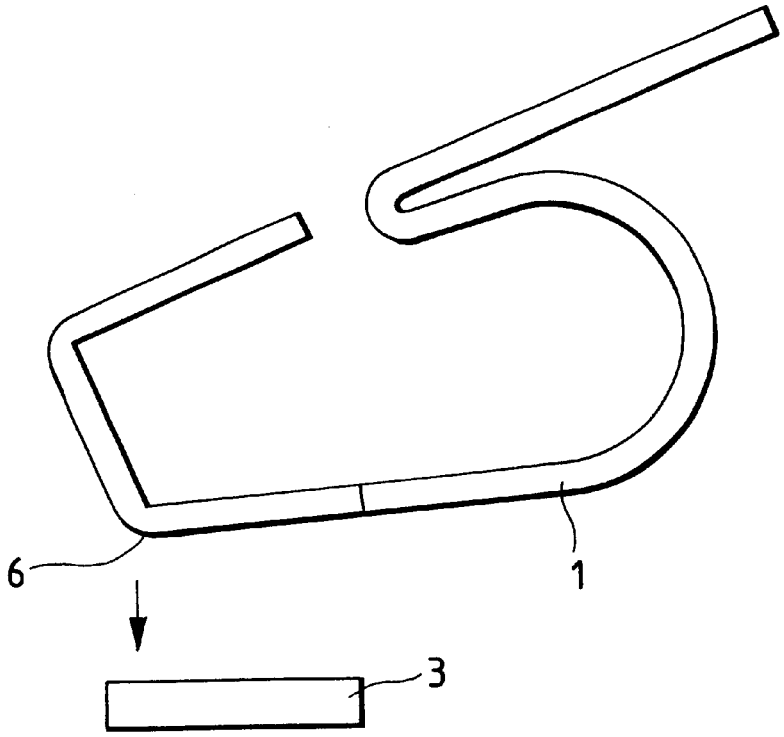
FIGS. 5A and 5B are cross-sectional views which illustrate the state of contact when a marking-off is provided for the pressing portion.
Figure 5B:
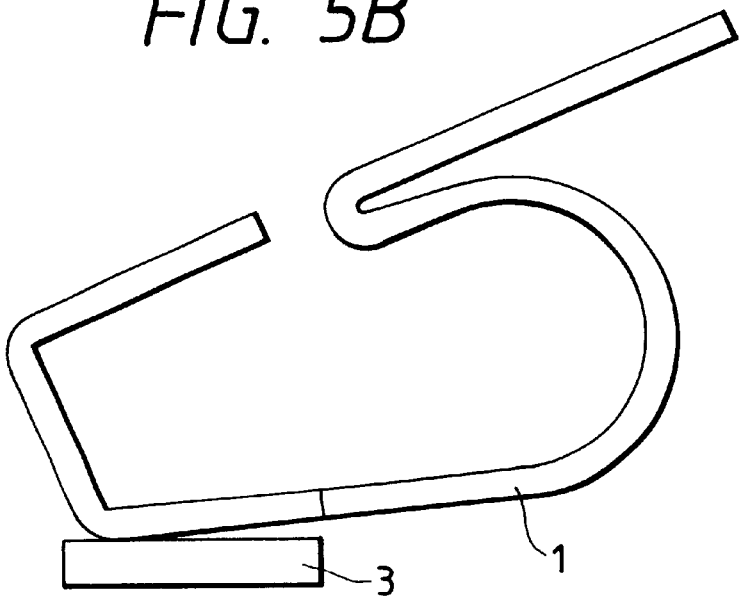

Also, as shown in FIGS. 5A and 5B, a marking-off 6 is arranged for the surface of the pressing portion which is linearly in contact with the reverse side of the substrate 3 in the vicinity of the heat generating source 5. Then, the pressing portion is caused to be in contact with the substrate 3 so that such marking-off is squeezed. In this manner, the contact area is made larger still. When the contact area is larger, the coefficient of thermal conductivity becomes better proportionately to make heat radiation easier. In this case, it is preferable to arrange such marking-off in a width smaller than the length of the ink flow path of the ceiling plate 2. If the width of the marking-off is not smaller than the length of the ink flow path, it becomes difficult for the pressure member 1 to effectuate the close contact between the ink flow paths of the ceiling plate 2 and the substrate 3 appropriately. As a result, there is a fear that ink is not discharged as designed in some cases.

(Embodiment 2)

Figure 6:
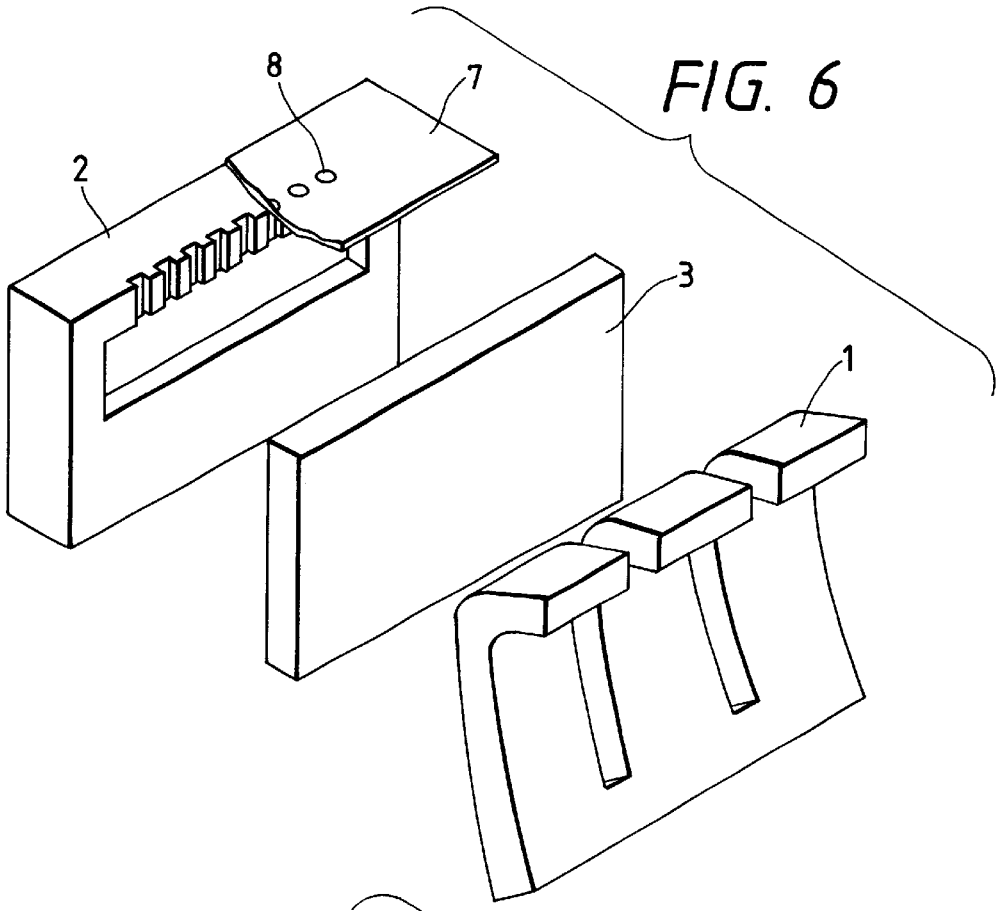
FIG. 6 is an exploded perspective view which shows the case where a plurality of linear pressures are exerted by the pressing portion of the pressure member.
Figure 7:
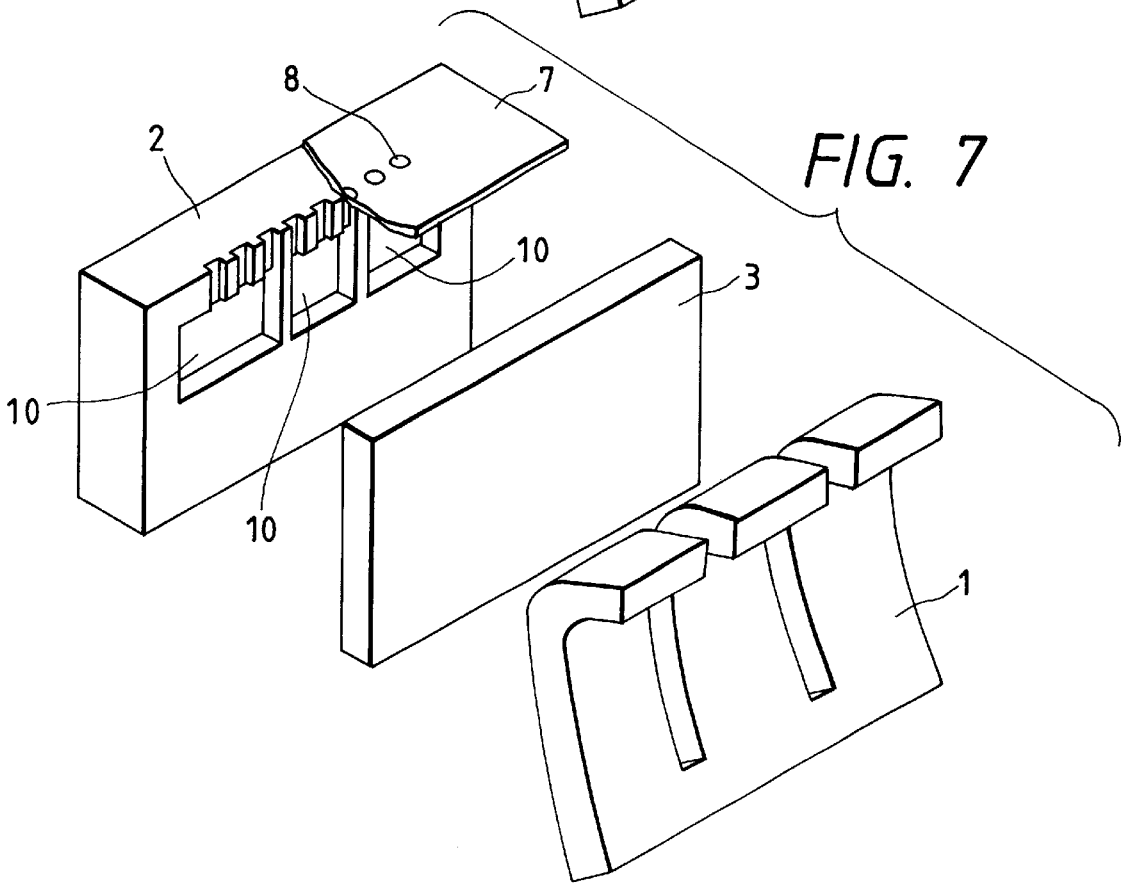
FIG. 7 is an exploded perspective view which shows the state where a plurality of liquid chambers are arranged for a ceiling plate.

FIG. 6 is a view corresponding to FIG. 1, which shows a second embodiment in accordance with the present invention. As shown in FIG. 6, the linear pressure is divided plurally to enhance the closeness of contact between the ceiling plate 2 and the substrate 3, because even if there is a warp on the reverse side of the substrate 3, pressure is exerted by each individual linear pressure following such condition of the reverse side better than when pressed only by one linear pressure. The more freely the divisions are provided, the more the closeness of contact is enhanced. In this case, it is possible to obtain a secure contact even for a head having a plurality of liquid chambers 10 as shown in FIG. 7.

Thermal energy is generated from the heat generating source on the substrate 3 for discharging ink, and a part of heat thus generated is transferred to ink and radiated outside. Here, the remaining heat is transferred for radiation to the pressure member 1 positioned on the reverse side of the substrate 3. Therefore, it is preferable to adopt an elastic material which has also good thermal conductivity for the pressure member 1. For the present embodiment, phosphor bronze is adopted also in consideration of costs. In this respect, however, the material is not limited to it of course.

Figure 8:
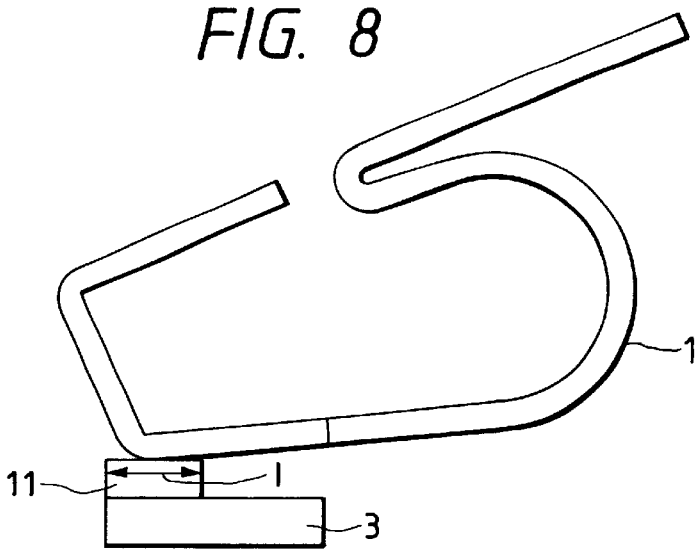
FIG. 8 is a view which shows a variational example where an Al member is arranged between the pressure member and substrate represented in FIG. 4.

Further, FIG. 8 shows an example of one variation of the structure represented in FIG. 4. A member 11 formed by aluminum or some other material having good thermal conductivity is arranged as a pressure member 1 between the substrate 3 and the plate member in order to enhance the effect of heat radiation. In this case, if the width of the aluminum member 11 is too wide, the closeness of contact is degraded. For the aluminum member 11, a careful consideration should be given to its width designated by a reference numeral 1 in FIG. 8.

(Embodiment 3)

Now, with reference to the accompanying drawings, the description will be made of a third embodiment in accordance with the present invention.

Figure 9:
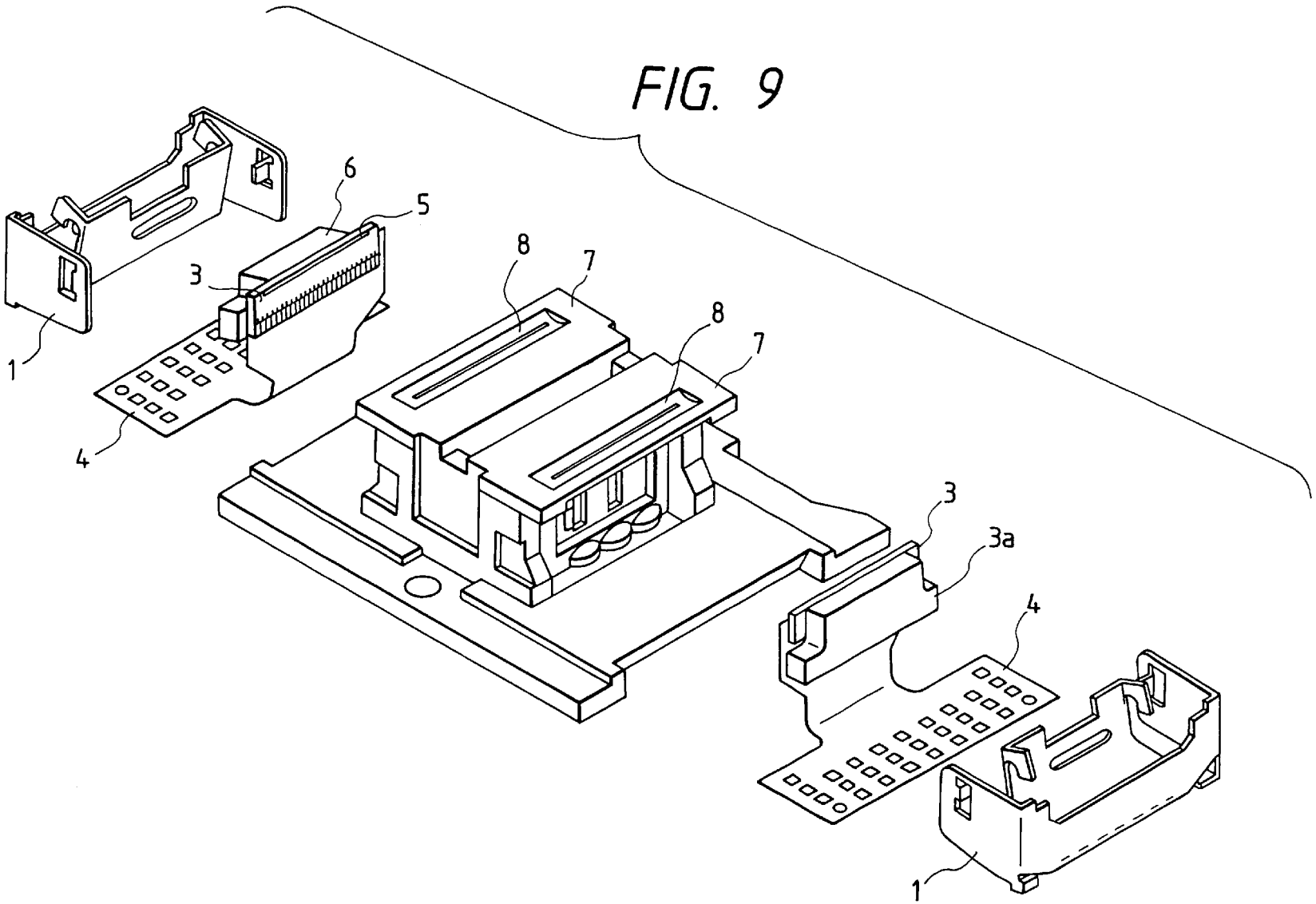
FIG. 9 is an exploded perspective view which shows an ink jet recording head in accordance with a third embodiment of the present invention.

FIG. 9 is an exploded perspective view which shows an ink jet recording head in accordance with the third embodiment of the present invention. Here, the same reference marks are applied to the same constituents as (or corresponding ones to) those of the previous embodiments represented in FIG. 1 to FIG. 8.

The recording head is structured in such a manner that a substrate 3 provided with electrothermal transducing devices to generate thermal energy for discharging ink arranged is coupled by means of a pressure member 1 with a ceiling plate 2 connected with an ink tank unit (not shown), which is provided with ink flow path grooves 9 (FIG. 10) and the discharge opening 8 for discharging ink.

Also, a small base plate 3*a* is fixed to the substrate 3. One end of the substrate is electrically connected with a wring substrate 4 that supplies electric power, electric signals and the like. The other end thereof is welded to the ceiling plate 2. This coupling is made in such a way that the ink flow grooves 9, which are conductively connected with the discharge openings 8 formed on the orifice plate 7 of the ceiling plate 2, are arranged corresponding to each position of the electrothermal transducing devices described above.

By means of such coupling, ink flow paths 9 and ink chambers 10 are formed. The substrate 3 and the ceiling plate 2 are in close contact accurately in order to discharge ink reliably and stably. In order to closely contact them reliably, the pressure member 1 is adopted for pressing the ceiling plate 2 and the substrate 3.

Figure 10:
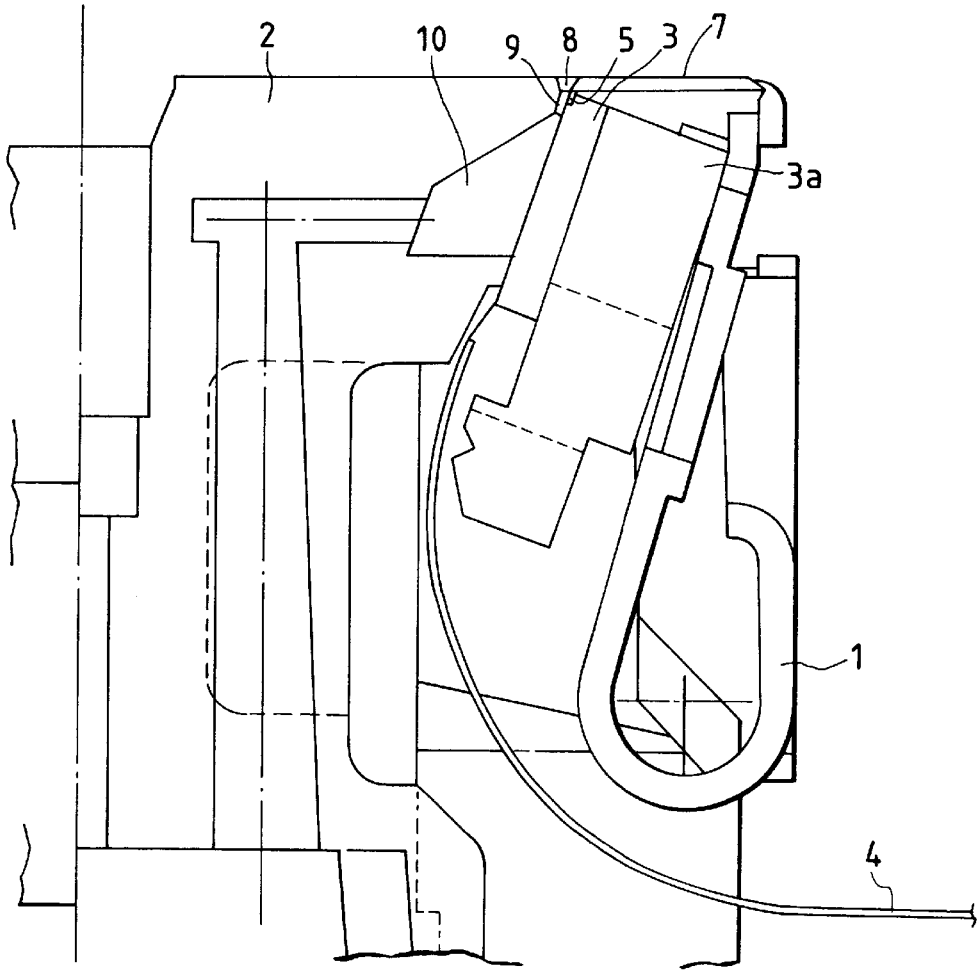
FIG. 10 is a cross-sectional view which shows the principal part of the recording head represented in FIG. 9.

Now, with reference to FIG. 10, the state of this pressure contact will be described. FIG. 10 is a cross-sectional view which shows the principal part of the recording head represented in FIG. 9. The pressure member 1 presses linearly the reverse side of the substrate 3 in the vicinity of the heat generating source 5 where the small base plate 3*a* is arranged. In consideration of the contact to be made closely between the ceiling plate 2 and the substrate 3, it is preferable to set a location on the ink flow paths 9 so as to securely press the leading end of the substrate 3 in the discharging direction linearly.

Further, then, the end face of the pressure member is arranged in a position away from the orifice plate by approximately 0.2 mm, and the gap thus formed is filled with a sealing material in order to reinforce the orifice plate 7.

The heat, which is partly caused by the heat generating source on the substrate 3 due to the thermal energy generated for discharging ink, is transferred to ink and radiated outside the recording head. Then, the remaining heat is transferred to the small base plate 3*a* as well as to the pressure member 1 arranged on the reverse side of the substrate 3 for radiation.

For the radiation of heat generated by the substrate 3, the one that becomes high instantaneously when ink is discharged is allowed to escape by means of the small base plate 3*a* formed by a material having a higher thermal conductivity than that of the pressure member 1, and then, the heat generated during ink discharges is being transferred to the pressure member 1 through the smaller base plate 3*a* for radiation.

(Embodiment 4)

Figure 11:
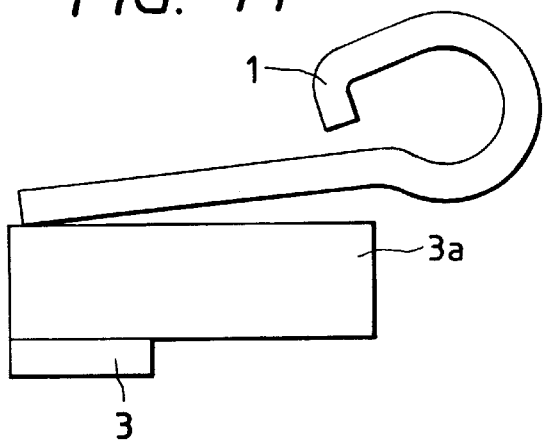
FIG. 11 is an enlarged sectional view which shows the state of contact in accordance with a fourth embodiment of the present invention.

FIG. 11 is an enlarged sectional view which shows the state of contact between a pressure member 1 and a substrate 3 having a small base plate 3*a* arranged therefor in accordance with a fourth embodiment of the present invention.

Now, in consideration of the fact that the pressure member 1 is formed by a metallic plate or the like, the configuration of the pressing portion where the substrate 3 having the small base plate 3*a*, and the pressure member 1 are in contact with each other is made to provide a smaller area when the substrate 3 is pressed by the end face of such plate member through the small base plate 3 as shown in FIG. 11.

(Embodiment 5)

Figure 12:
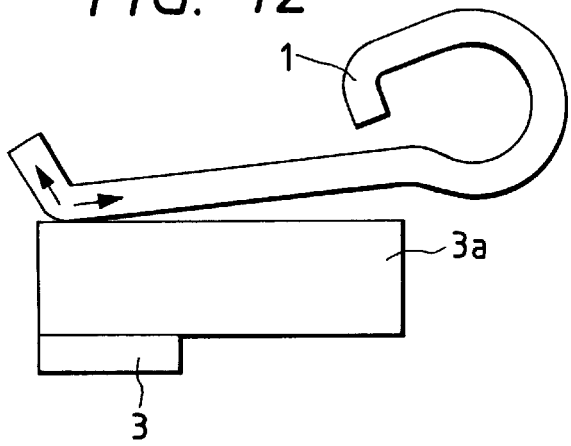
FIG. 12 is an enlarged sectional view which shows the state of contact in accordance with a fifth embodiment of the present invention.

With more importance being attached to the efficiency of heat radiation through the pressing portion as compared with the fourth embodiment described above, the pressing portion may be folded so that the direction of heat transfer is made two ways, instead of only one way, as indicated by arrows in FIG. 12 which corresponds to FIG. 11, but represents a fifth embodiment in accordance with the present invention. In this manner, the sectional area that acts upon heat conductivity is made approximately two times that shown in FIG. 11 to enhance the efficiency of heat radiation.

(Embodiment 6)

Figure 13:
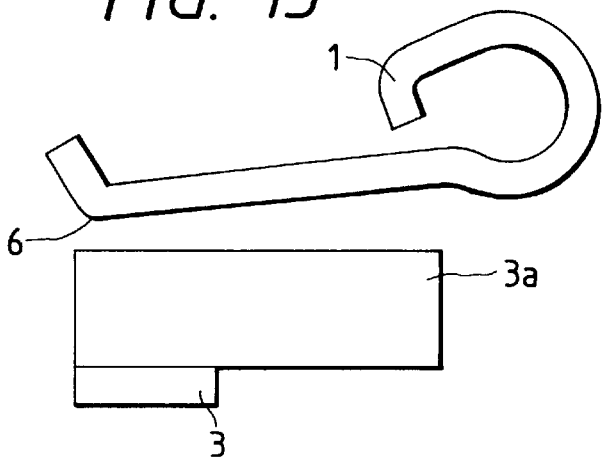
FIG. 13 is an enlarged sectional view which shows the state of contact in accordance with a sixth embodiment of the present invention.

Also, as a sixth embodiment in accordance with the present invention, a marking-off 6 is arranged for the surface of the pressing portion that is linearly in contact with the reverse side of the substrate 3 in the vicinity of heat generating source 5 as shown in FIG. 13 which corresponds to FIG. 12, and then, the pressing portion is allowed to be in contact with the substrate 3 so that the marking-off 6 is squeezed. In this way, the contact area becomes larger to make the coefficient of thermal conductivity better proportionally. The heat radiation is also made easier. In this case, it is preferable to set the width of the marking-off 6 smaller than the length of ink flow path of the ceiling plate 2. If the width of the marking-off 6 is not smaller than the length of the ink flow path, it becomes difficult to effectuate the close contact between the ink flow paths 9 of the ceiling plate 2 and the substrate 3. As a result, there is a fear that ink discharges are not made efficiently in some cases.

Beside such arrangement, it may be possible to fill a resin material having good thermal conductivity in the vicinity of the linearly pressed portion.

Also, for the pressure member 1, it is considered better to adopt a metallic material having good spring capability as well as a higher coefficient of thermal conductivity in order to press the substrate and the ink flow paths of the ceiling plate.

For each of the embodiments described above, phosphor bronze is adopted for the material of the pressure member also in consideration of its costs. In this respect, however, it is not limited only to the use of such material of course.

(Embodiment 7)

Figure 14:
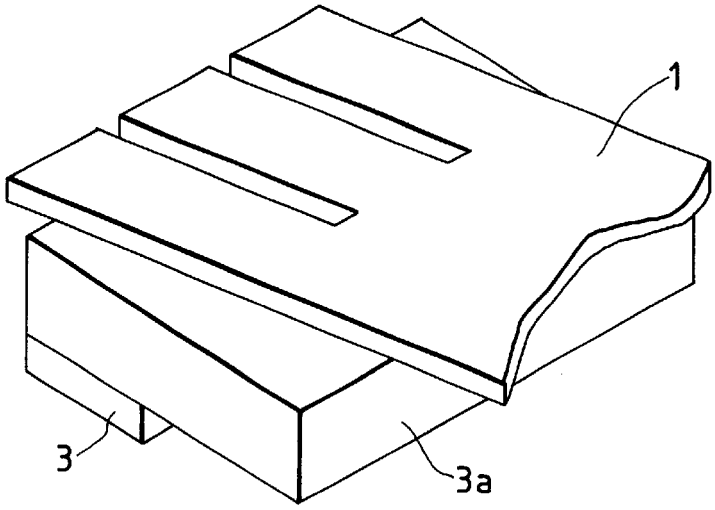
FIG. 14 is an exploded perspective view which shows the state of contact in accordance with a seventh embodiment of the present invention.
Figure 15:
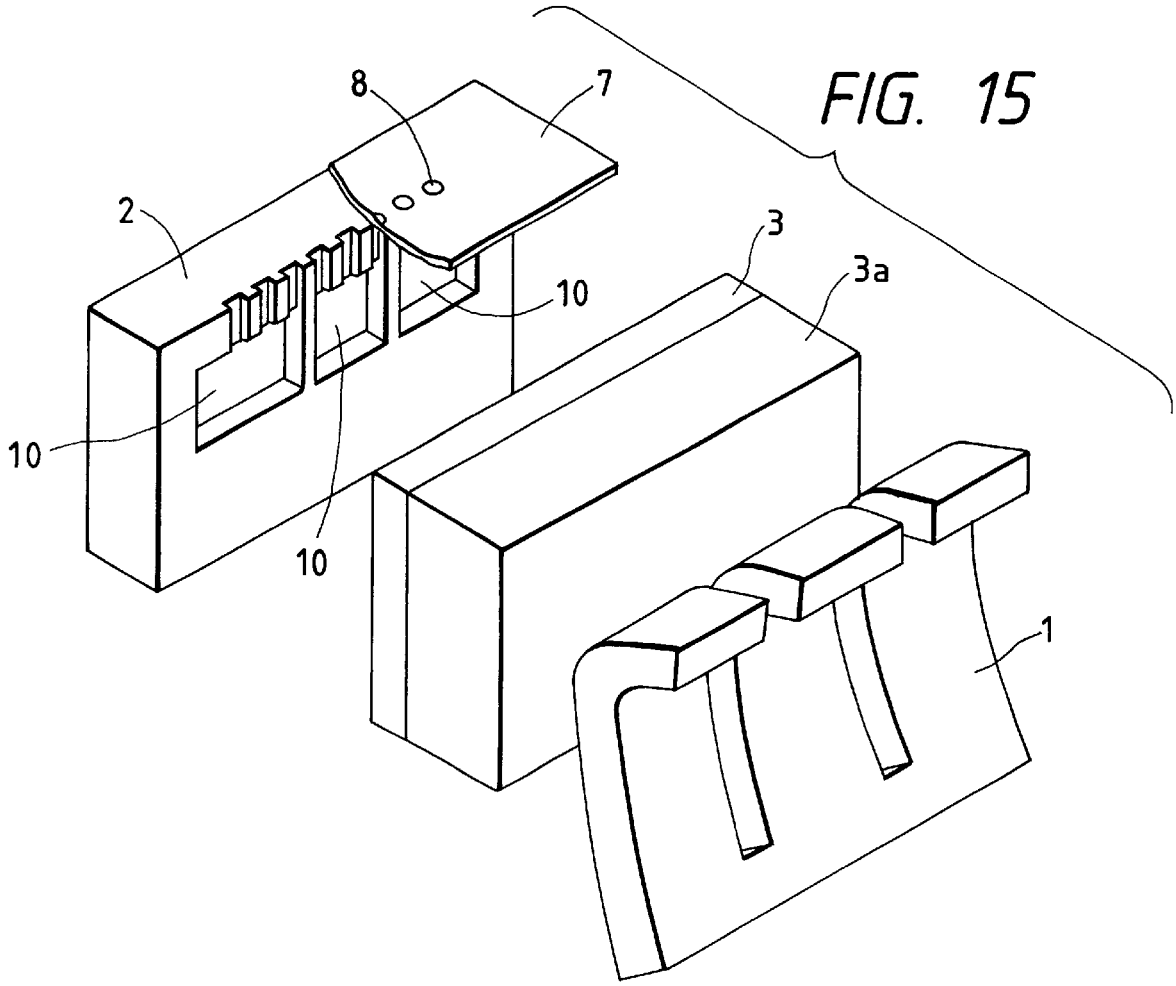
FIG. 15 is an exploded perspective view which shows the case where a plurality of liquid chambers are arranged for a ceiling plate.
Figure 16:
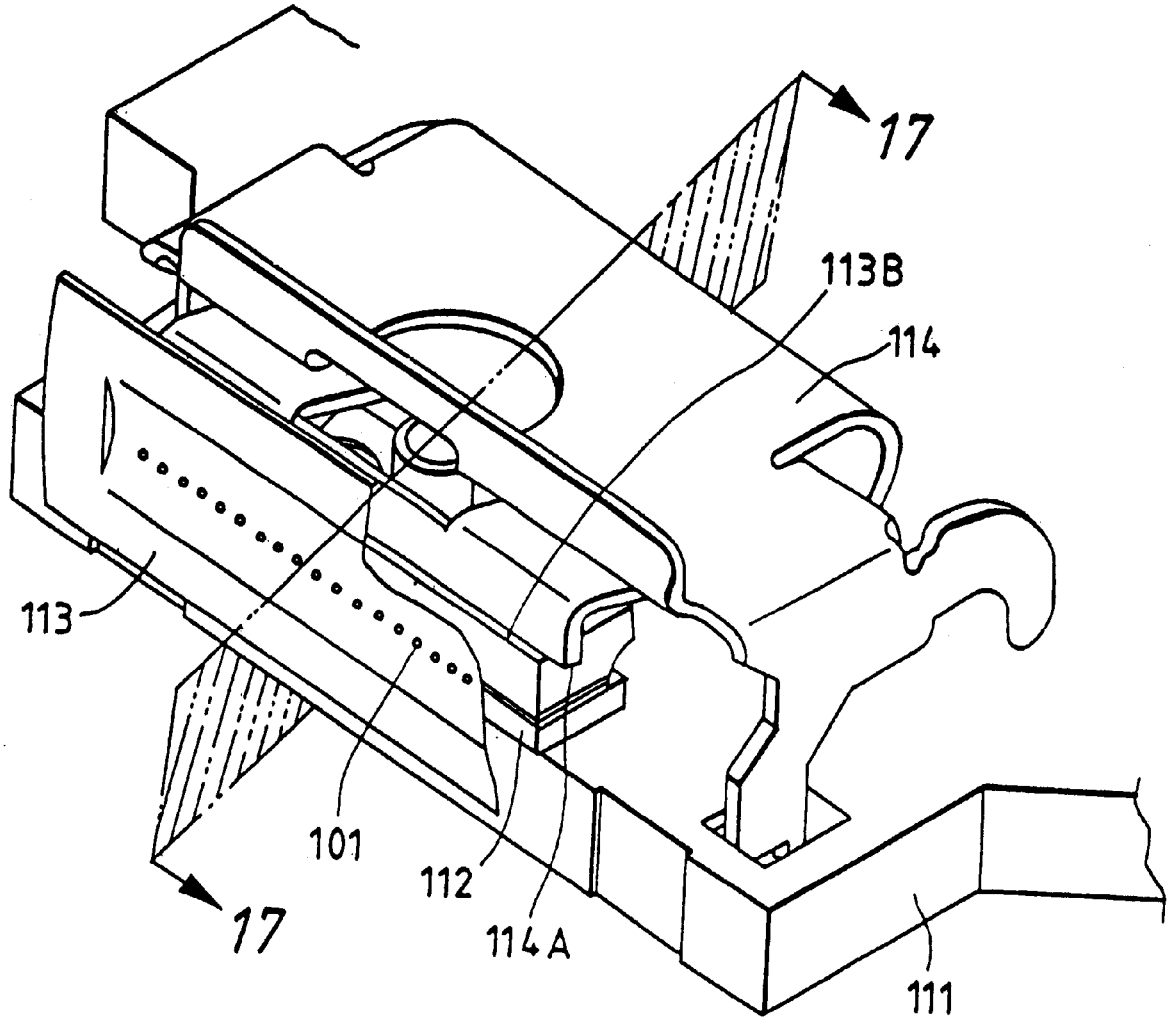
FIG. 16 PRIOR ART
FIG. 16 is a perspective view which schematically shows the principal part of the conventional ink jet recording head.
Figure 17:
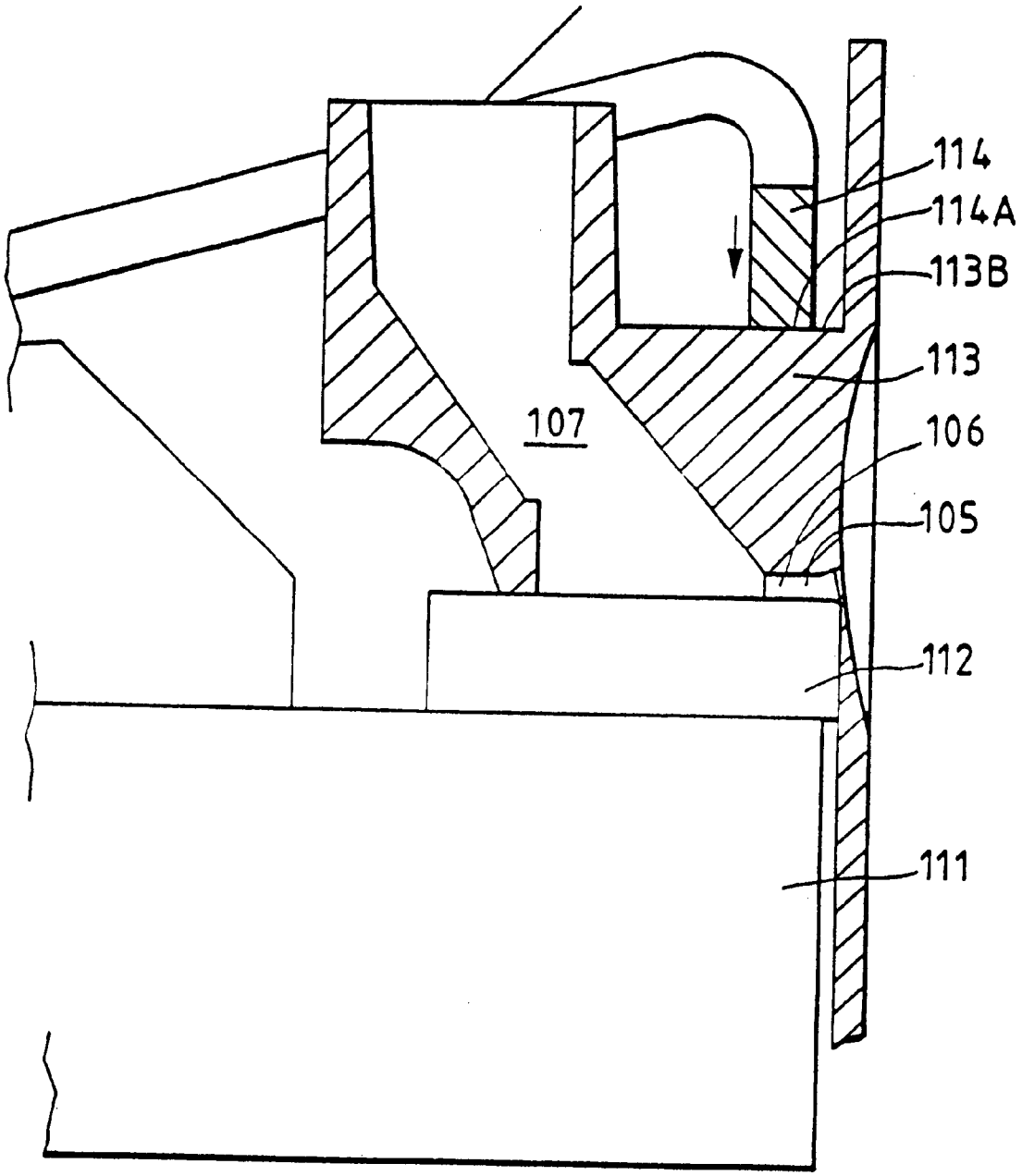
FIG. 17 PRIOR ART
FIG. 17 is a view which schematically shows the section of the head, taken along line 17—17 in FIG. 16.

FIG. 14 is an exploded perspective view which shows a seventh embodiment in accordance with the present invention. When the base plate 3*a* is extremely thin or there is no base plate at all, the state of linear pressure is made more even to exert pressure stably if the linear pressure of the pressing portion is divided plurally as shown in FIG. 14. Not only such uniform pressure, but also, the close contactness is enhanced between the ceiling plate 2 and the substrate 3 even when there is a warp on the reverse side of the substrate, because each of the linear pressures is individually exerted following the condition of the reverse side of the substrate better than when pressed only by one linear pressure. The more the numbers of such divisions, the more the close contactness is enhanced. In this case, a close contact is obtainable even when a head has a plurality of liquid chambers in it as shown in FIG. 15 which is an exploded perspective view illustrating such a head.

What is claimed is:

1. An ink jet recording head comprising:

a grooved ceiling plate provided with a plurality of discharge openings for discharging ink, and a plurality of ink flow path grooves to form ink flow paths conductively connected with said discharge openings;

a plurality of elemental substrates disposed opposite said grooved ceiling plate and provided with a plurality of electrothermal transducing devices to generate thermal energy used for discharging said ink, each said elemental substrate being smaller than said ceiling plate and having a reverse side that has an area exposed to ambience; and a metallic pressure member for pressing said plurality of elemental substrates into contact with said grooved ceiling plate, said pressure member having an area exposed to ambience which is larger than the exposed area of the reverse side of any of said elemental substrates, and having a pressing portion, said pressing portion pressing against the reverse sides of said elemental substrates only in a vicinity of said electrothermal transducing devices, wherein said grooved ceiling plate and said elemental substrates are coupled so that said ink flow path grooves and said electrothermal transducing devices correspond to each other for the formation of ink flow paths, and said pressure member presses the reverse side of the surface of said elemental substrates having said electrothermal transducing devices provided therefor in order to couple said elemental substrates with said grooved ceiling plate.

2. An ink jet recording head according to claim 1, wherein said grooved ceiling plate is provided with an orifice plate unit, and said discharge openings are arranged in correspondence with said orifice plate unit.

3. An ink jet recording head according to claim 2, wherein said ink flow path grooves are inclined with respect to said orifice plate unit.

4. An ink jet recording head according to claim 1, wherein said pressure member presses said elemental substrates by the application of a linear pressure, said pressure member extending in a direction.

5. An ink jet recording head according to claim 4, wherein the direction along which said pressure member extends is substantially parallel to an arrangement direction of the discharge openings.

6. An ink jet recording head according to claim 4, wherein a width of said linear pressure is smaller than the length of said ink flow path.

7. An ink jet recording head according to claim 1, wherein said pressure member is formed at least in two directions from the pressing portion.

8. An ink jet recording head according to claim 1, wherein each of said elemental substrates are coupled on a location facing said grooved ceiling plate, respectively.

9. An ink jet cartridge comprising:

an ink jet recording head according to claim 1; and an ink tank retaining an ink for supply to said ink jet recording head.

10. An ink jet recording apparatus mounting thereon an ink jet recording head according to claim 1.

11. An ink jet recording head comprising:

a grooved ceiling plate provided with a plurality of discharge openings for discharging ink, and a plurality of ink flow path grooves to form ink flow paths conductively connected with said discharge openings;

a plurality of elemental substrates disposed opposite said grooved ceiling plate and provided with a plurality of electrothermal transducing devices to generate thermal energy used for discharging said ink, each said elemental substrate being smaller than said ceiling plate and having a reverse side that has an area exposed to ambience; and a metallic pressure member for pressing said plurality of elemental substrates into contact with said grooved ceiling plate, said pressure member having an area exposed to ambience which is larger than the exposed area of the reverse side of any of said elemental substrates, and having a pressing portion, said pressing portion pressing against the reverse sides of said elemental substrates only in a vicinity of said electrothermal transducing devices, wherein said grooved ceiling plate and said elemental substrates are coupled so that said ink flow path grooves and said electrothermal transducing devices correspond to each other for the formation of ink flow paths, and said ink jet recording head further comprises, on the reverse side of said elemental substrates having said electrothermal transducing devices provided therefor, a member having a high thermal conductivity, and said pressure member presses said member having the high thermal conductivity so as to couple said elemental substrates together with said grooved ceiling plate.

12. An ink jet recording head according to claim 11, wherein said grooved ceiling plate is provided with an orifice plate unit, and said discharge openings are arranged for said orifice plate unit.

13. An ink jet recording head according to claim 12, wherein said ink flow path grooves are inclined with respect to said orifice plate unit.

14. An ink jet recording head according to claim 11, wherein said pressure member presses said elemental substrates by the application of linear pressure.

15. An ink jet recording head according to claim 14, wherein the direction of said linear pressure is substantially parallel with the arrangement direction of discharge openings.

16. An ink jet recording head according to claim 15, wherein a width of said linear pressure is smaller than the length of said ink flow path.

17. An ink jet recording head according to claim 11, wherein said pressing portion of said pressure member is shaped so as to press said elemental substrates with plural linear pressures.

18. An ink jet recording head according to claim 17, wherein said plural linear pressures are aligned along a straight line.

19. An ink jet recording head according to claim 17, wherein said pressing portion of said pressure member is shaped so that said plural linear pressures are applied independently.

20. An ink jet cartridge comprising:

an ink jet recording head according to claim 9; and an ink tank retaining an ink for supply to said ink jet recording head.

21. An ink jet recording apparatus mounting thereon an ink jet recording head according to claim 1.

* * * * *

UNITED STATES PATENT AND TRADEMARK OFFICE

CERTIFICATE OF CORRECTION

PATENT NO. : 6,371,594 B1
DATED : April 16, 2002
INVENTOR(S) : Wataru Takahashi et al.

It is certified that error appears in the above-identified patent and that said Letters Patent is hereby corrected as shown below:

Column 3,
Line 7, “stable” should read -- stably --.

Column 10,
Line 29, “claim 1.” should read -- claim 11. --.

Signed and Sealed this

Twenty-second Day of July, 2003

JAMES E. ROGAN
*Director of the United States Patent and Trademark Office*